US007168258B2

(12) United States Patent
Al-Khateeb

(10) Patent No.: US 7,168,258 B2
(45) Date of Patent: Jan. 30, 2007

(54) REAL TEMPERATURE OUTPUT AIR CONDITIONER

(76) Inventor: Osama Othman Mostaeen Al-Khateeb, P.O. Box 2145, Safat 13022 (KW)

( * ) Notice: Subject to any disclaimer, the term of this patent is extended or adjusted under 35 U.S.C. 154(b) by 413 days.

(21) Appl. No.: 10/753,814

(22) Filed: Jan. 8, 2004

(65) Prior Publication Data

US 2005/0150239 A1 Jul. 14, 2005

(51) Int. Cl.
*F25B 29/00* (2006.01)

(52) U.S. Cl. ..... 62/173; 62/185; 62/201; 236/1 C

(58) Field of Classification Search ..... 62/173, 62/185, 201; 236/1 C
See application file for complete search history.

(56) References Cited

U.S. PATENT DOCUMENTS 3,921,413 A * 11/1975 Kohlbeck ..... 62/173
4,067,383 A * 1/1978 Padden ..... 165/247
4,850,201 A * 7/1989 Oswalt et al. ..... 62/185
5,261,251 A * 11/1993 Galiyano ..... 62/176.6
5,711,161 A * 1/1998 Gustafson ..... 62/197
5,730,216 A * 3/1998 Viegas et al. ..... 165/233
5,921,090 A * 7/1999 Jurewicz et al. ..... 62/50.2
6,062,030 A * 5/2000 Viegas ..... 62/175
6,076,360 A * 6/2000 Viegas et al. ..... 62/50.2
6,095,427 A * 8/2000 Hoium et al. ..... 236/49.3
6,122,923 A * 9/2000 Sullivan ..... 62/174
6,276,152 B1 * 8/2001 Sibik ..... 62/201
6,631,621 B2 * 10/2003 VanderWoude et al. ..... 62/201

* cited by examiner

*Primary Examiner*—Cheryl Tyler
*Assistant Examiner*—Gene L Bankhead
(74) *Attorney, Agent, or Firm*—Michael I Kroll

(57) ABSTRACT

A real temperature output air conditioner which lowers the ambient temperature of an interior space to a desired temperature and, once that has been achieved, delivers a constant flow of air at that specific temperature thereto. The present invention further includes a reservoir within the evaporator unit in which the evaporator coils and heater element are immersed. The evaporator coils and heat element act upon the fluid wherein thermal transfer to the ambient air is enhanced and dissipated to the interior space by the evaporator fan.

20 Claims, 11 Drawing Sheets

REAL TEMPERATURE OUTPUT AIR CONDITIONER

BACKGROUND OF THE INVENTION

1. Field of the Invention

The present invention relates generally to air conditioning devices and, more specifically, to an air conditioning unit that is designed to bring the ambient temperature of an interior area to a specific temperature and once having reached that temperature maintaining it thereat by introducing air that has been heated or cooled to the specific desired temperature into the room. The gas conduit and heat coil within the evaporator unit are immersed in a fluid which is heated or cooled accordingly to the selected temperature and an air current is passed through vents in communication therewith to disburse the thermally conditioned air into the interior air.

The heart of the present invention lies in the thermal control circuit which governs the administration of the device. The thermal control circuit comprises a main power switch to provide power from an AC power source, a function switch to direct current between the cooling cycle and the heat cycle, a fluid thermostat for the cooling cycle and a heat thermostat each immersed in the fluid in the evaporator unit, an air thermostat and a control unit for transferring current between the air thermostat and the fluid thermostat. The fluid thermostat controls current flow to the compressor and the condenser fan. The first operational state of the present invention is the start-up cycle which is only active when the unit is initially turned on wherein the air thermostat determines that the ambient air temperature is higher than the user selected desired temperature and operates the compressor and condenser fan constantly until equilibrium between the two is achieved. The air thermostat signals the control unit that the ambient temperature is at the desired temperature and switches to the fluid thermostat to initiate the fluid cycle wherein current to the compressor and the condenser fan is regulated by the fluid thermostat to alternate between the fluid cooling stage and the fluid maintenance stage to maintain a stable fluid temperature and, therefore, a stable real temperature output. The start-up cycle does not operate again until the unit is turned off and turned on again, it will not work at all during the remaining operation of the unit. The fluid cooling stage maintains operation of the compressor and the condenser fan to lower the fluid temperature whereas the compressor and condenser fan are disabled during the fluid maintenance stage until the fluid temperature and real temperature output rise above the desired temperature. The evaporator fan remains on to suck air from the room and push the real temperature conditioned air into the room.

The other operational state of the present invention is the heater mode wherein the function switch is selected to heater to send current to the heater thermostat to activate the heat coil and raise the temperature of the fluid and turn off the heat coil when the desired temperature has been achieved. The evaporator fan remains on to suck air from the room and push the real temperature conditioned air into the room.

2. Description of the Prior Art

There are other air conditioning systems known in the art, while these air conditioning systems may be suitable for the purposes for which they were designed, they would not be as suitable for the purposes of the present invention, as hereinafter described.

SUMMARY OF THE PRESENT INVENTION

A primary object of the present invention is to provide a real air temperature output air conditioner that will heat or cool an interior space to a user selected temperature and then will maintain the selected temperature once reached by disbursing air conditioned to that temperature into the interior air.

Another object of the present invention is to provide a real air temperature output air conditioner capable of providing cooled or heated air as needed.

Still another object of the present invention is to provide a real air temperature output air conditioner wherein the evaporator coil and heating element are immersed in a fluid contained within a reservoir of the evaporator unit wherein the fluid is used to provide thermal transfer to the ambient air.

Yet another object of the present invention is to provide a real air temperature output air conditioner that will provide improved thermal control of an interior space.

Another object of the present invention is to provide a real air temperature output air conditioner that will reduce illness in the sick and elderly who are prone to respond poorly to great temperature differentials.

Yet another object of the present invention is to provide a real air temperature output air conditioner that will reduce illness by not introducing overly cooled or heated air into the interior as is common in the prior art.

Still another object of the present invention is to provide a real air temperature output air conditioner that is simple and easy to use.

Still yet another object of the present invention is to provide a real air temperature output air conditioner that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
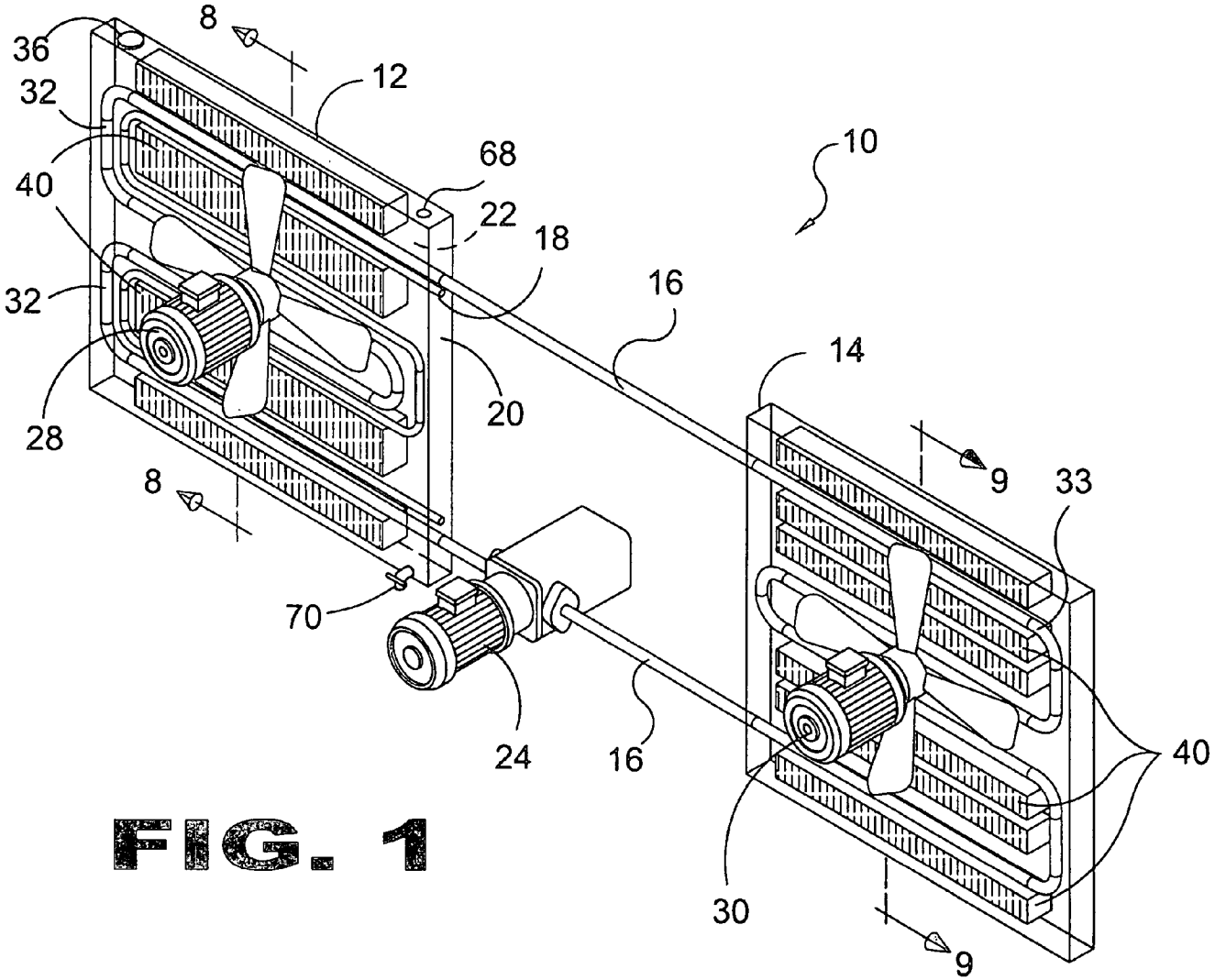
FIG. 1 is an illustrative view of the present invention.

Turning now descriptively to the drawings, in which similar reference characters denote similar elements throughout the several views, the figures illustrate the Real Temperature Output Air Conditioner of the present invention. With regard to the reference numerals used, the following numbering is used throughout the various drawing figures.

10 Real Temperature Output Air Conditioner
12 evaporator unit
14 condenser unit
16 gas conduit
18 heat element
20 fluid reservoir of 12
22 fluid
24 compressor
26 gas
28 evaporator fan
30 condenser fan
32 evaporator coils of 12
33 condenser coils of 14
36 fill port of 20
40 vents
41 AC power source
42 main power switch
44 function switch
46 cooling cycle connection of 44
48 heating cycle connection 44
50 control unit
52 air thermostat
54 fluid thermostat
56 heater thermostat
58 user control panel
60 digital control panel
61 control switch for fluid and air thermostats
62 manual control panel
63 control switch for heater thermostat
64 digital thermostat control
66 fan-speed control switch
68 pressure relief valve
70 petcock
72 first electrical wire
74 second electrical wire
76 third electrical wire
78 fourth electrical wire
80 fifth electrical wire
82 sixth electrical wire
84 seventh electrical wire
85 eighth electrical wire
86 ninth electrical wire
88 tenth electrical wire
89 eleventh electrical wire
90 twelfth electrical wire
92 thirteenth electrical wire
94 fourteenth electrical wire
96 fifteenth electrical wire

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention. Shown is an illustrative view of the real temperature output air conditioner of the present invention 10. The present invention functions similar to a typical air conditioner having an evaporator unit 12, a condenser unit 14, a looped, closed gas conduit 16 communicating therebetween and traveling in a serpentine manner when passing through said evaporator unit 12 and said condenser unit 14 with a compressor 24 in line therewith for compressing the gas as it travels to the condenser unit 14 thereby creating a pressure condition. A condenser fan 30 exhausts the residual heat from the pressurized gas traveling through the condenser coils 33 to the exterior air through vents 40 while and evaporator fan 28 provides thermal transfer and dissipates the conditioned air to the interior air. The serpentine portion of the gas conduit 16 within the evaporator unit 12 comprise the evaporator coils 32. The evaporator coils 32 and a heat element 18 are immersed in fluid 22 within a fluid reservoir 20 integral with the evaporator unit 12 and serve to achieve and maintain the fluid 22 at a specified temperature for thermal transfer. A pressure relief valve 68 is disposed on a top portion of the evaporator unit 12 and serves to prevent the unit from exploding in the event of excessive temperatures. A petcock 70 is included on a bottom portion of the evaporator unit 12 to drain the fluid 22 therefrom if necessary. A fill port 36 provides access to add fluid 22 to the reservoir 20.

Figure 2:
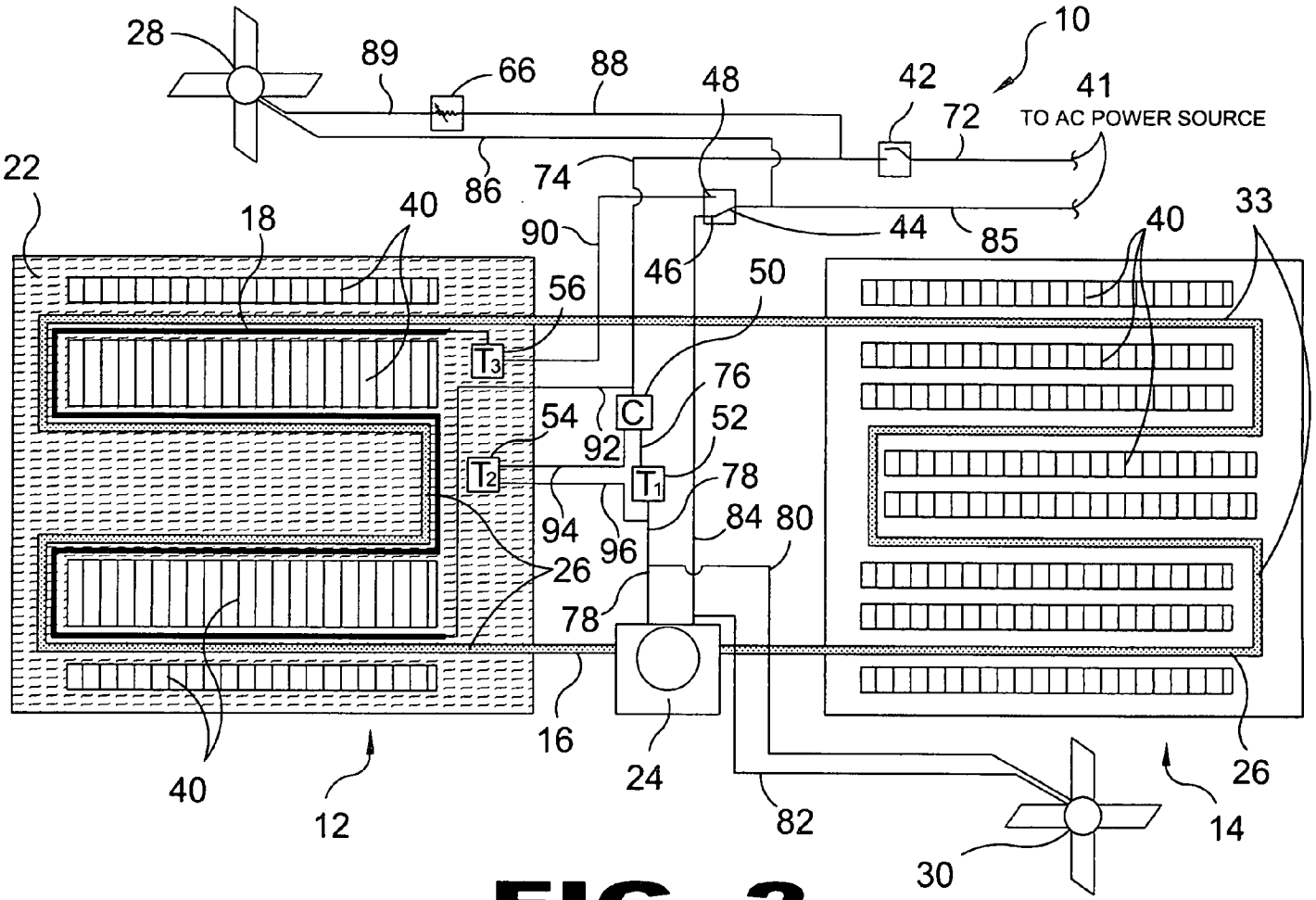
FIG. 2 is a detailed general overview of the present invention.

FIG. 2 is a detailed general overview of the present invention 10. Shown is the present invention 10 having an evaporator unit 12 and a condenser unit 14 during the off stage wherein the main power switch 42 is open thereby preventing operation of the unit. The evaporator fan 28 serves to deliver treated air through vents 40 into the interior room and suck air from the room. The evaporator fan 28 speed may be manually adjusted by the user through the use of the variable fan speed control switch 66. The function switch 44 determines whether current is distributed to the heat thermostat 56 or to the control unit 50 depending upon whether it is contacting the cooling cycle connection 46 or the heating cycle connection 48. The control unit 50 transfers current from the air thermostat 52 to the fluid thermostat 54, which is immersed in fluid 22 when the interior temperature reaches the selected temperature. The air thermostat 52 and the fluid thermostat 54 respectively deliver current to the compressor 24 and the condenser fan 30 which operate continuously to compress the gas 26 within the gas conduit 16 and to exhaust excessive heat therefrom during the cooling start-up cycle and intermittently during the fluid cycle. The evaporator fan 28 sucks the air from the room and pushes the conditioned air through the vents 40 in the evaporator unit 12 and the condenser fan 30 blows heat emitted from the condenser coils 33 due to the high pressure gas 26 traveling therein through the vents 40 in the condenser unit 14. The function switch 44 provides a user control for transferring current between the cooling cycle and the heating cycle which occurs when power is supplied to the heat thermostat 56 and the heater element 18. The electrical circuit of the present invention 10 further includes a first electrical wire 72 communicating between the AC power source 41 and the main power switch 42, a second electrical wire 74 connecting the main power switch 42 to the control unit 50, a third electrical wire 76 between the control unit 50 and the air thermostat 52, a fourth electrical wire 78 between the air thermostat 52 and the compressor 24, a fifth electrical wire 80 between the fourth electrical wire 78 and the condenser fan 30, a sixth electrical wire 82 between the condenser fan 30 and the seventh electrical wire 84 which connects the compressor 24 to the main function switch 44, an eighth electrical wire 85 between the main function switch 44 and the AC power source 41, a ninth electrical wire 86 communicating between the evaporator fan 28 and the eighth electrical wire 85, a tenth electrical wire 88 between the second electrical wire 74 and the variable speed switch 66, an eleventh electrical wire 89 connecting the variable speed switch 66 to the evaporator fan 28, a twelfth electrical wire 90 connecting the function switch 44 to the heat thermostat 56, a thirteenth electrical wire 92 between the second electrical wire 74 and heat element 18, a fourteenth electrical wire 94 between the control unit 50 and the fluid thermostat 54, and a fifteenth electrical wire 96 connecting the fluid thermostat 54 to the fourth electrical wire 78.

Figure 3:
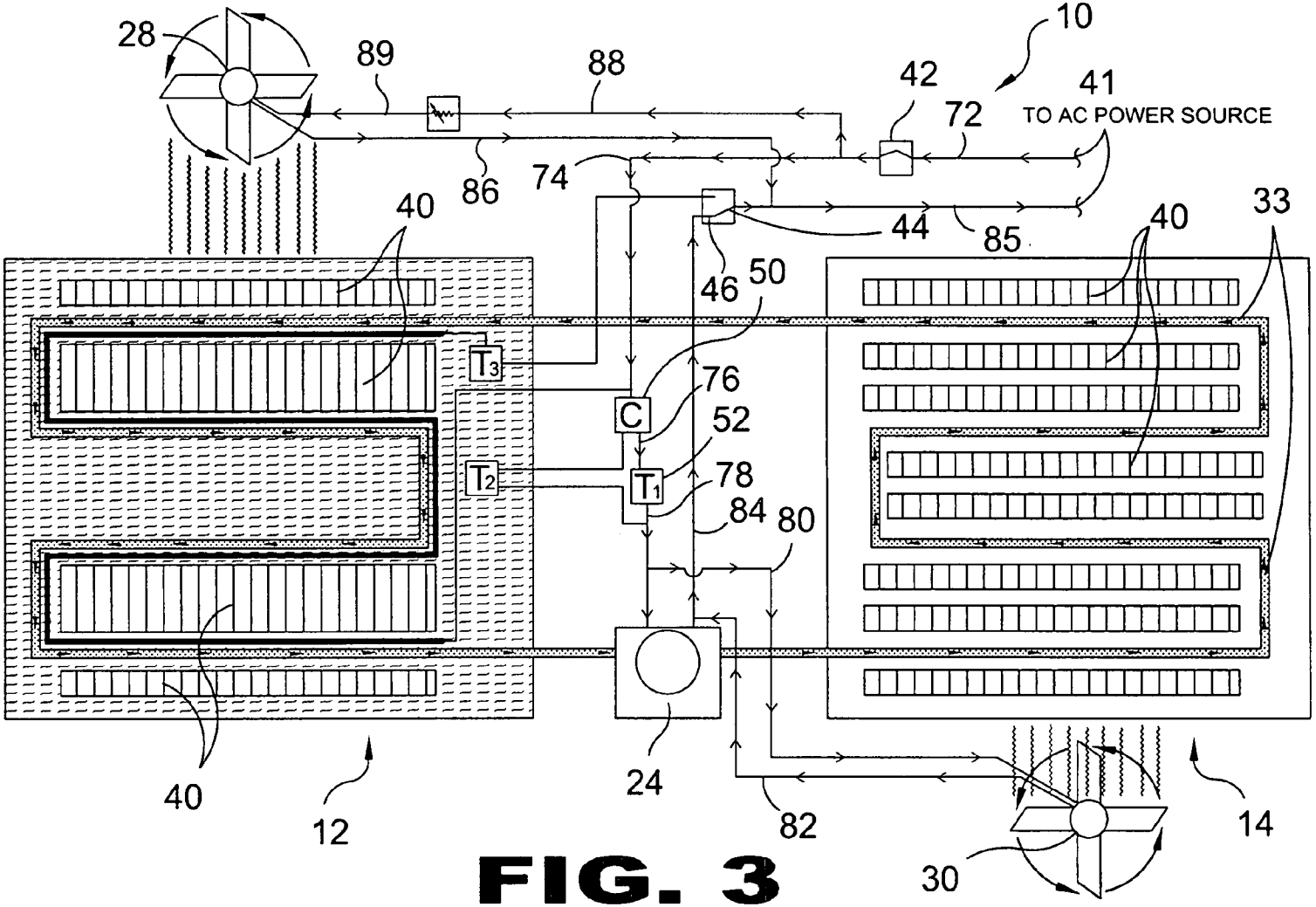
FIG. 3 is a detailed view of the present invention during the start-up circuit.

FIG. 3 is a detailed view of the present invention 10 during the start-up circuit. Shown is the present invention 10 during the initial start-up cooling stage wherein the main power switch 42 is closed thereby initiating operation of the unit. The evaporator fan 28 of the evaporator unit 12 is rotating whenever the unit is on regardless of the function being performed to suck ambient air from the interior room and recycle the treated air through the vents 40 thereto. The function switch 44 is set to send current to the cooling cycle connection 46 thereof to enable the cooling mode and power from the AC power source 41 is distributed to the control unit 50 and current is sent to the air thermostat 52 due to the temperature discrepancy that is present between the ambient air temperature and the desired temperature as set by the user. The air thermostat 52 delivers current to the compressor 24 and the condenser fan 30 which operate continuously during the cooling start-up cycle until the ambient air achieves the desired temperature. The condenser fan 30 passes an air flow through the vents 40 of the condenser unit 14 to remove excessive heat from the condenser coils 33. Arrows are used to demonstrate the operating circuit during one phase of the AC power cycle. The electrical wires that are energized during the start-up circuit are the first electrical wire 72, the second electrical wire 74, the third electrical wire 76, the fourth electrical wire 78, the fifth electrical wire 80, the sixth electrical wire 82, the seventh electrical wire 84, the eighth electrical wire 85 to operate the compressor 24 and the condenser fan 30, and, the tenth electrical wire 88, the eleventh electrical wire 89, and the ninth electrical wire 86 to operate the evaporator fan 28.

Figure 4:
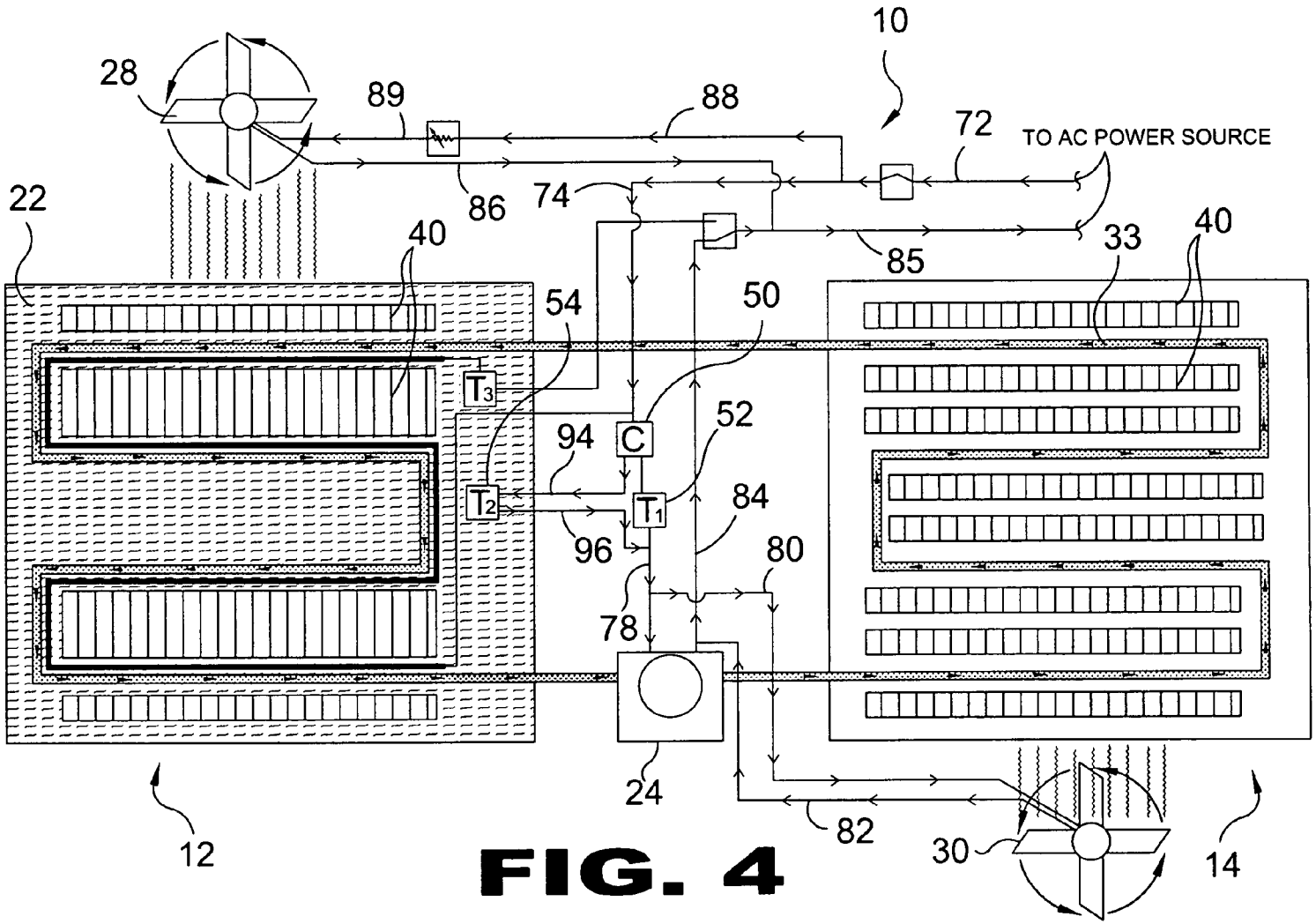
FIG. 4 is a detailed view of the present invention during the fluid cooling stage.

FIG. 4 is a detailed view of the present invention 10 during the fluid 22 cooling stage. Shown is the present invention 10 during the fluid 22 cooling stage which occurs once the ambient room temperature achieves the desired temperature thereby causing the air thermostat 52 to notify the control unit 50 that equilibrium has been reached causing the control unit 50 to switch current over to the fluid thermostat 54. The fluid thermostat 54 then regulates the temperature of the fluid 22 inside the evaporator unit 12 and, subsequently, the fan 28 delivers a steady flow of real temperature air through the vents 40 into the room. The air thermostat 52 will not operate again during the operation of the unit until it is turned off and turned on again thereby initiating the start-up cycle. All subsequent thermal control is governed by the fluid thermostat 54 once transfer from the start-up cycle is accomplished. The fluid thermostat 54 maintains a stable fluid 22 temperature by switching the compressor 24 and the condenser fan 30 on and off as needed. The condenser fan 30 passes an air flow through the vents 40 of the condenser unit 14 to remove excessive heat from the condenser coils 33. The electrical wires that are energized during the start-up circuit are the first electrical wire 72, the second electrical wire 74, the fourteenth electrical wire 94, the fifteenth electrical wire 96, the fourth electrical wire 78, the fifth electrical wire 80, the sixth electrical wire 82, the seventh electrical wire 84, the eighth electrical wire 85 to operate the compressor 24 and the condenser fan 30, and the tenth electrical wire 88, the eleventh electrical wire 89, the ninth electrical wire 86, to operate the evaporator fan 28.

Figure 5:
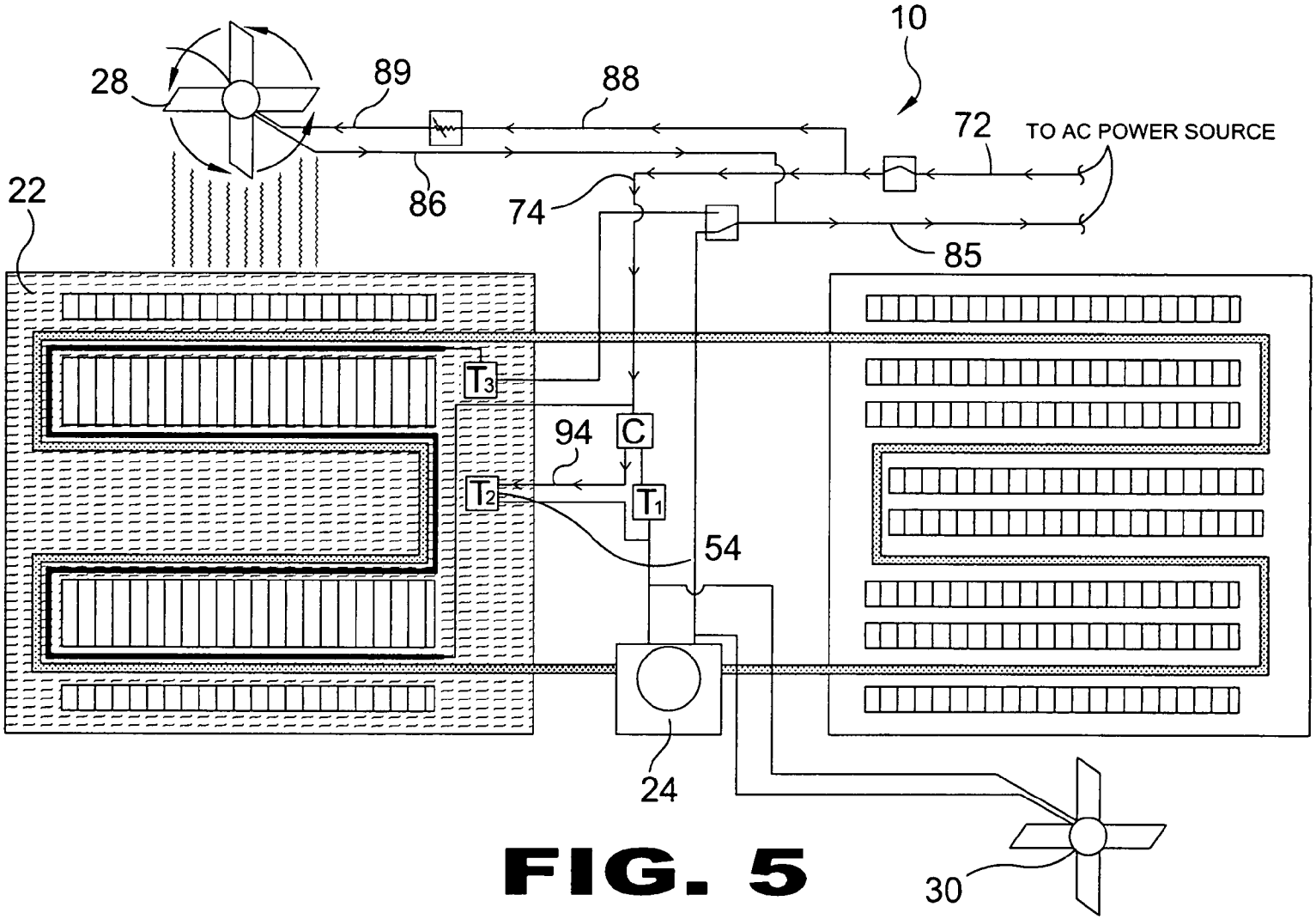
FIG. 5 is a detailed view of the present invention during the fluid maintenance stage.

FIG. 5 is a detailed view of the present invention 10 during the fluid 22 maintenance stage wherein the evaporator fan 28 is operating continuously to deliver real temperature air flow into the room. Shown is the present invention 10 during the fluid 22 maintenance stage which occurs once the ambient room temperature and the fluid 22 achieve the desired temperature thereby causing the fluid thermostat 54 to intermittently disrupt current to the compressor 24 and the condenser fan 30 which remain off for the short period of time until the fluid 22 has warmed above the desired temperature and the fluid thermostat 54 restores current to the condenser fan 30 and compressor 24. The electrical wires that are energized during the fluid maintenance stage are the first electrical wire 72, the second electrical wire 74, the fourteenth electrical wire 94 where current is stopped by the fluid thermostat 54, and the tenth electrical wire 88, the eleventh electrical wire 89, the ninth electrical wire 86 and the eighth electrical wire 85 to operate the evaporator fan 28.

Figure 6:
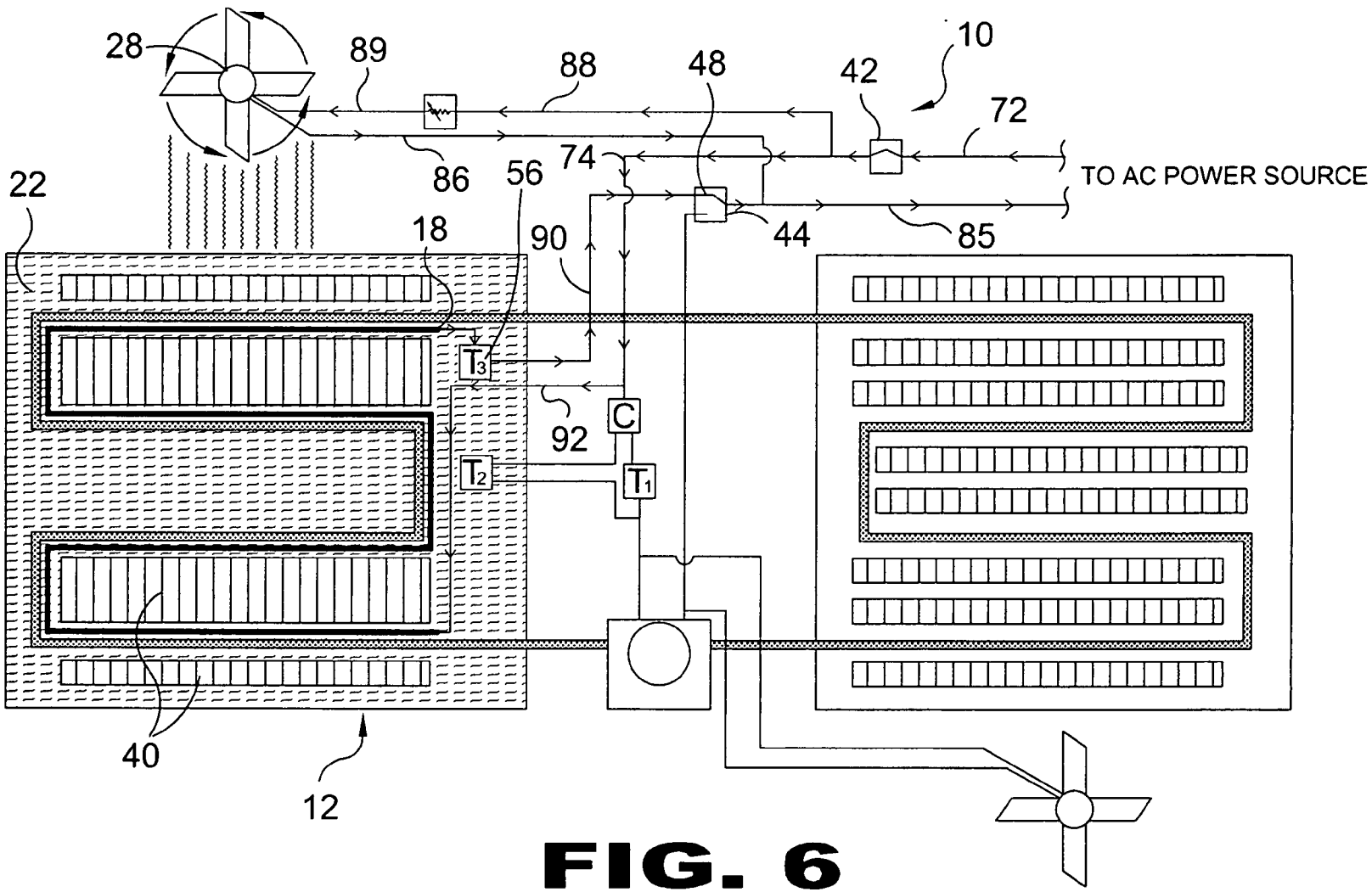
FIG. 6 is a detailed view of the present invention in the heating mode.

FIG. 6 is a detailed view of the present invention 10 in the heating mode. Shown is the present invention 10 with the power switch 42 closed and function switch 44 in heater mode delivering current to the heating cycle connection 48 thereof thereby activating the heat thermostat 56 to control the immersed heater element 18 that heats the fluid and turns off and on as needed to maintain a stable temperature of the fluid 22 to provide real temperature output through the thermal transfer therefrom. The evaporator fan 28 applies airflow through the evaporator unit 12 and the resultant warmed air is introduced through the vents 40 into the room at the desired temperature. The electrical wires that are energized during the heater mode are the first electrical wire 72, the second electrical wire 74, the thirteenth electrical wire 92, the twelfth electrical wire 90, the eighth electrical wire 85 to operate the heater element 18, and the tenth electrical wire 88, the eleventh electrical wire 89, and the ninth electrical wire 86 to operate the evaporator fan 28.

Figure 7:
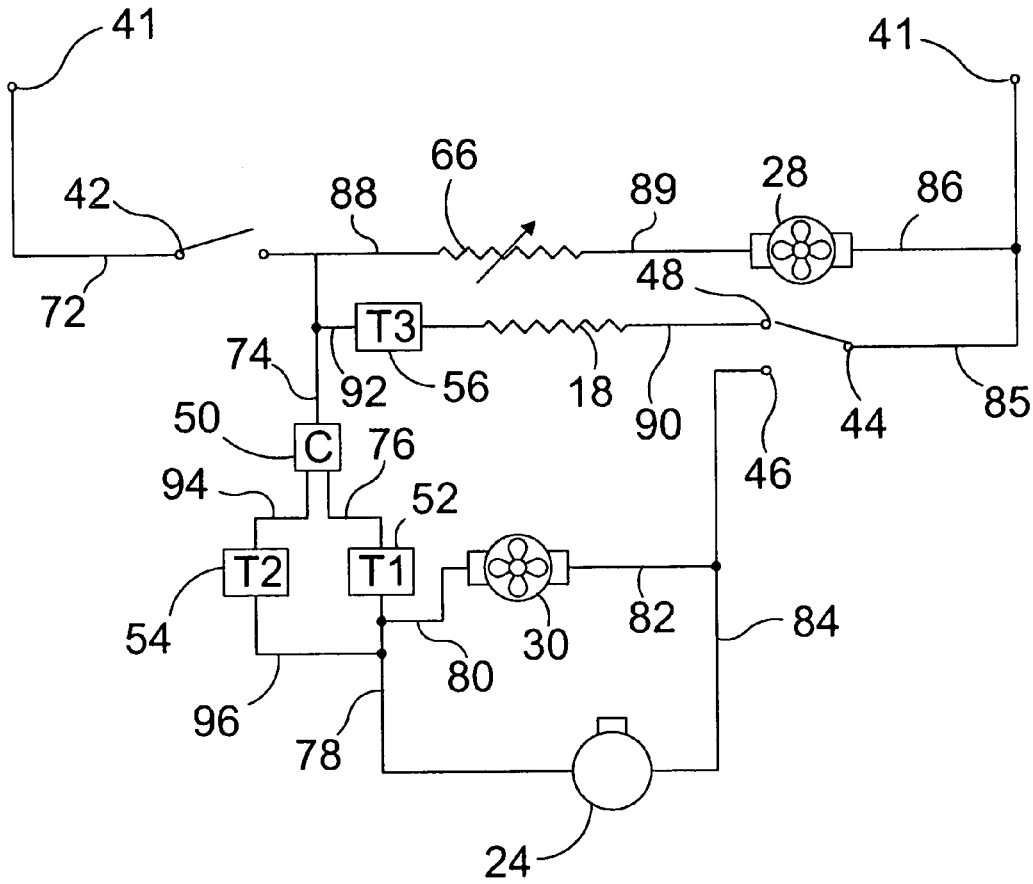
FIG. 7 is an electrical schematic diagram of the electrical operation of the present invention.

FIG. 7 is an electrical schematic diagram of the electrical operation of the present invention. Shown is the thermal control circuit of the present invention. The main power switch 42, the variable fan speed control 66 and function selection switch 44 are the user controls. Shown also are the heater element 18, the condenser fan 30, the compressor 24, the control unit 50, the air thermostat 52, the fluid thermostat 54 and the heater thermostat 56. The electrical circuit of the present invention further includes a first electrical wire 72 communicating between the AC power source 41 and the main power switch 42, a second electrical wire 74 connecting the main power switch 42 to the control unit 50, a third electrical wire 76 between the control unit 50 and the air thermostat 52, a fourth electrical wire 78 between the air thermostat 52 and the compressor 24, a fifth electrical wire 80 between the fourth electrical wire 78 and the condenser fan 30, a sixth electrical wire 82 between the condenser fan 30 and the seventh electrical wire 84 which connects the compressor 24 to the cooling cycle connection 46 of the main function switch 44, an eighth electrical wire 85 between the main function switch 44 and the AC power source 41, a ninth electrical wire 86 communicating between the evaporator fan 28 and the eighth electrical wire 85, a tenth electrical wire 88 between the main power switch 42 and the variable speed switch 66, an eleventh electrical wire 89 connecting the variable speed switch 66 to the evaporator fan 28, a twelfth electrical wire 90 connecting the heat cycle connector 48 of the function switch 44 to the heat element 18, a thirteenth electrical wire 92 between the second electrical wire 74 and heat thermostat 56, a fourteenth electrical wire 94 between the control unit 50 and the fluid thermostat 54, and a fifteenth electrical wire 96 connecting the fluid thermostat 54 to the fourth electrical wire 78.

Figure 8:
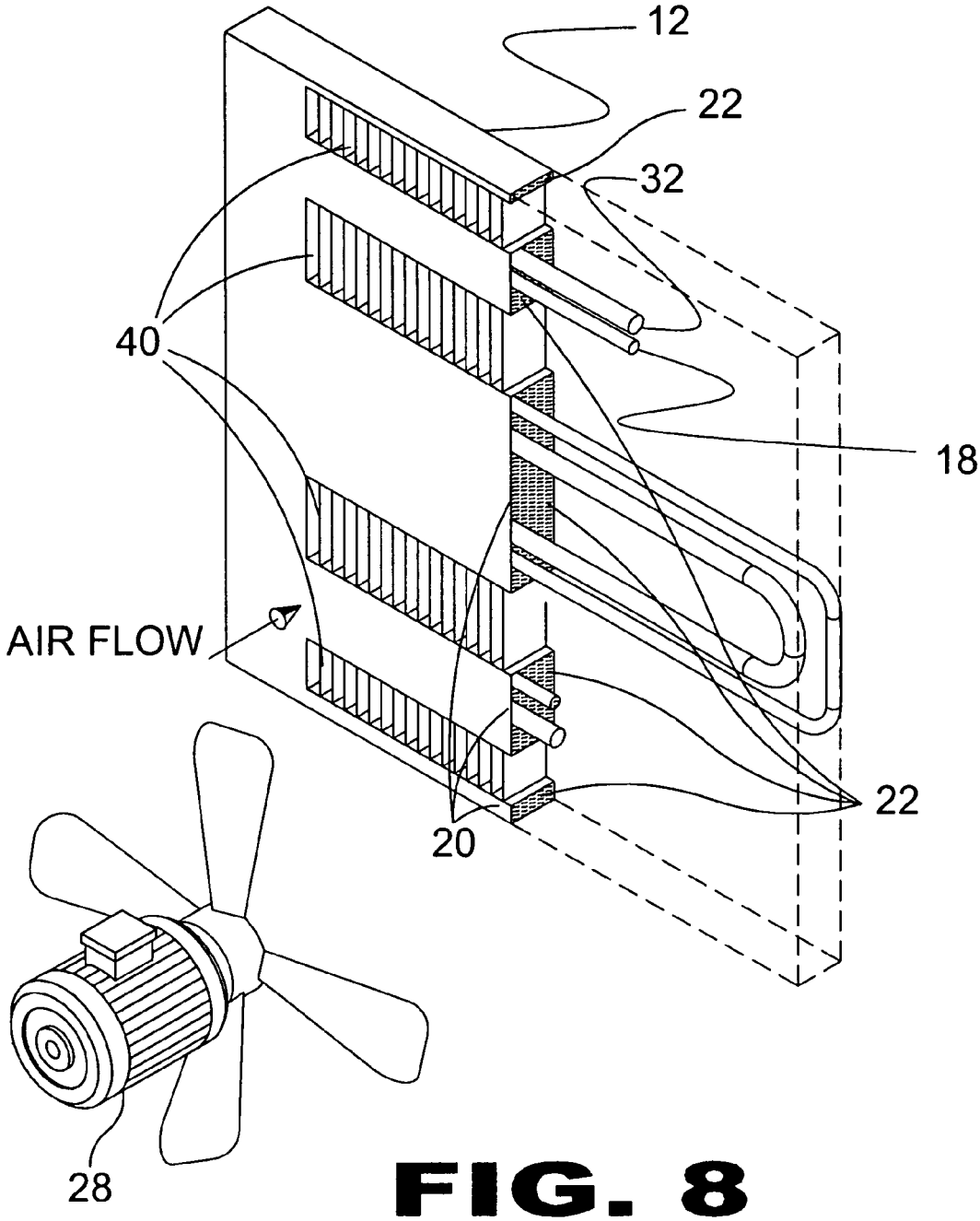
FIG. 8 is an isometric cross sectional view of the evaporator unit.

FIG. 8 is an isometric cross sectional view of the evaporator unit 12. FIG. 8 depicts an isometric cross section as indicated in FIG. 1. Prior art presents evaporator units 12 wherein the evaporator coils 32 are exposed to the supply air. The present invention provides a means of controlling the temperature of the supply air by submerging the evaporator coils 32 and an electric heater element 18 in a fluid 22 media. The fluid 22 media is contained in the reservoir 20 of the evaporator unit 12. During the cooling cycle the temperature of the fluid 22 media is controlled by the expanding gas in the low pressure stage transferring the cooler temperature through the vents 40 into the room. The evaporator fan 28 blows the treated air through the vents 40 while retrieving air from the room.

Figure 9:
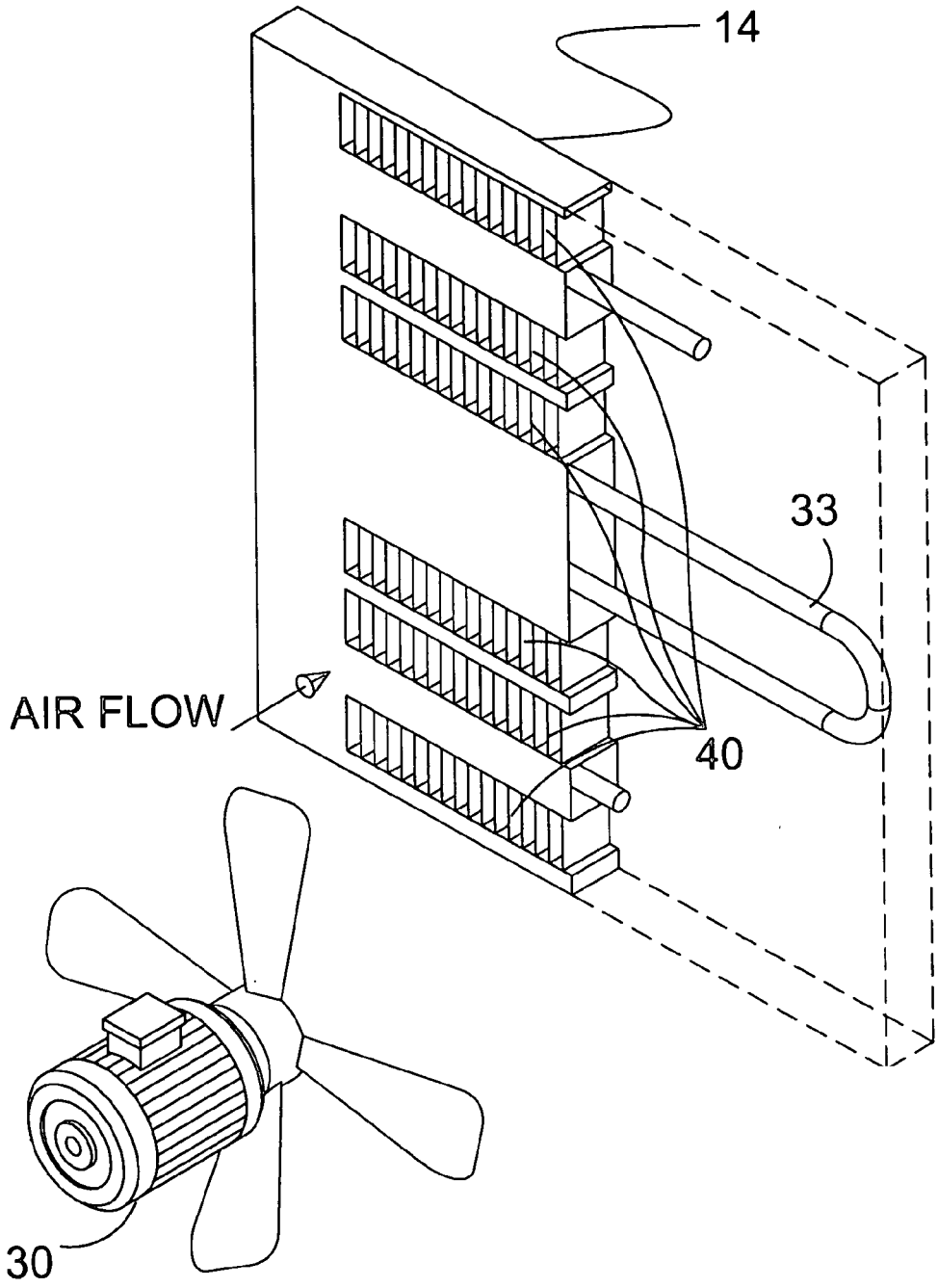
FIG. 9 is an isometric cross sectional view of the condenser unit.

FIG. 9 is an isometric cross sectional view of the condenser unit 14. FIG. 9 depicts an isometric cross section as indicated in FIG. 1. The condenser unit 14 provides exhaust means of transferring exhaust heat from the compressed gas passing through the condenser coils 33 in a high-pressure state by having the condenser fan 30 blow the heated air emitted therefrom through the vents 40 to the exterior air.

Figure 10:
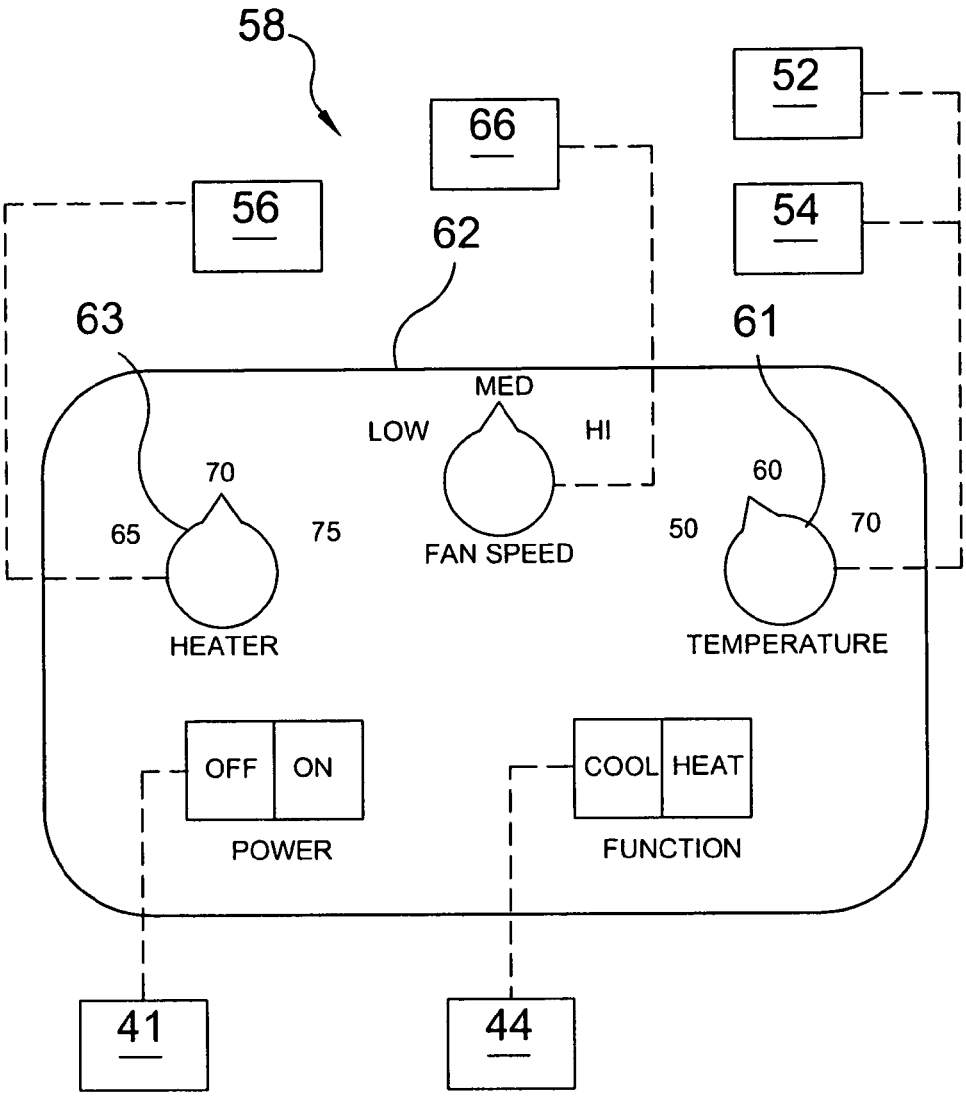
FIG. 10 is a front view of a manual control panel.

FIG. 10 is a front view of a user control panel 58 shown as a manual control panel 62. The user controls may be automatic, manual or any combination thereof. Shown is a manual control panel 62 with user controls for the main power switch 41, function switch 44, the control switch 61 for the air thermostat 52 and fluid thermostat 54 of the cooling cycle, evaporator fan speed control switch 66 and a control switch 63 for the heater thermostat 56. One control switch is provided for the air thermostat 52 and the fluid thermostat 54 because they operate sequentially to achieve the selected temperature.

Figure 11:
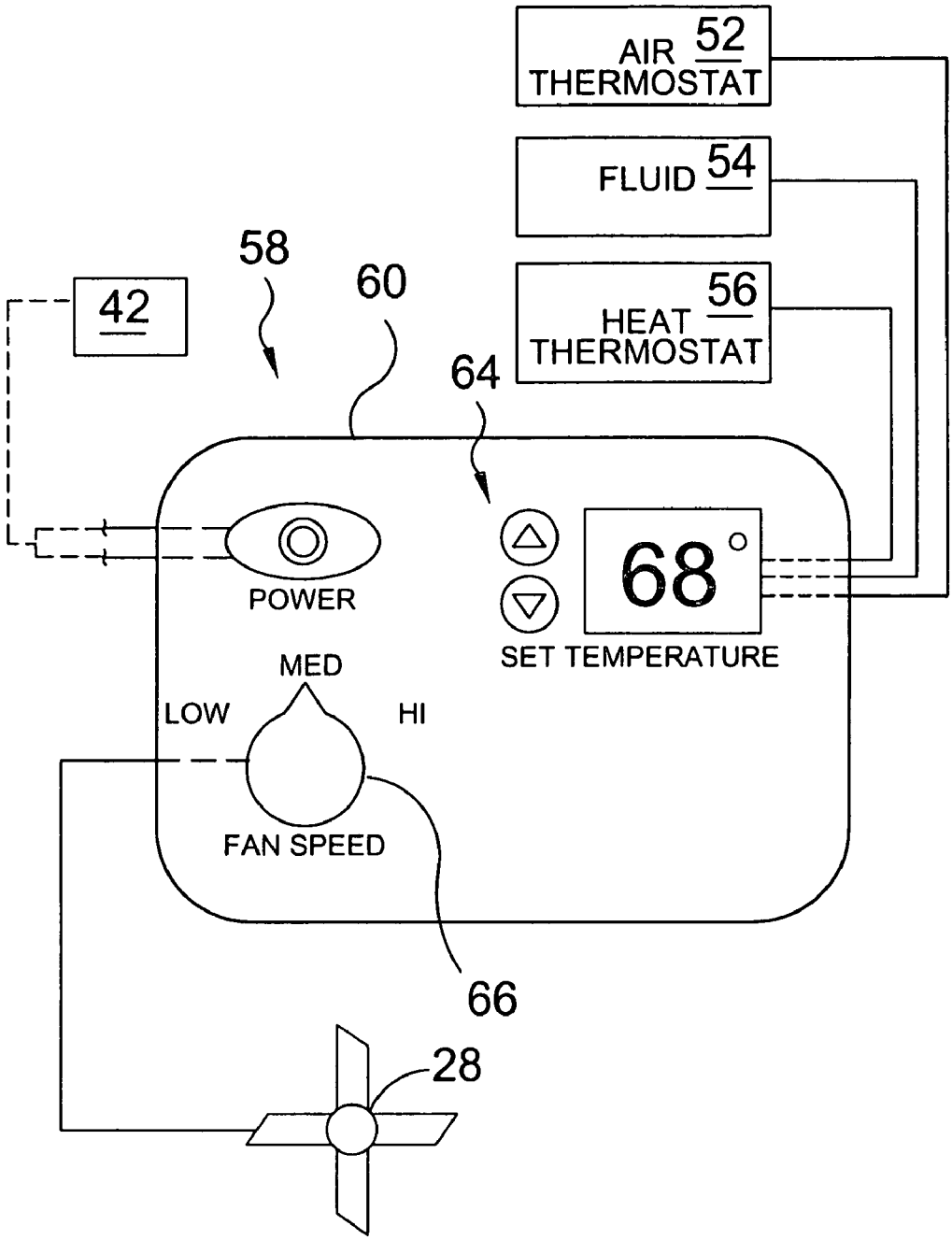
FIG. 11 is a front view of a digital control panel and the primary related components.

FIG. 11 is a front view of a user control panel 58 shown as a digital control panel 60 and the primary related components. The user controls may be automatic, manual or any combination thereof. Shown is a digital control panel 60 having a digital display to show the desired temperature and a digital thermostat control 64 for a user to adjust the temperature setting accordingly. The digital thermostat control 64 sets the desired temperature for the air thermostat 52 and fluid thermostat 54 to maintain the cooling cycle and the heater thermostat 56 to regulate the heat cycle as needed thereby enabling the present invention to maintain all season control at a selected comfortable temperature. A user control switch 66 to adjust the evaporator fan 28 speed is also included. A digital control panel 60 may be used year round and will determine which function is appropriate to maintain the selected temperature. The power switch 42 is used to supply power to the electrical circuit.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A real temperature output air conditioner comprising:

a) an evaporator unit;

b) a condenser unit;

c) a closed conduit having condenser coils passing through said condenser unit and evaporator coils passing through said evaporator unit;

d) gas contained within said conduit;

e) a compressor in line with said gas conduit disposed between said evaporator unit and said condenser unit for compressing and heating said gas prior to entry into said condenser unit;

f) a reservoir disposed within said evaporator unit in which said evaporator coils are situated;

g) fluid disposed within said reservoir and in physical communication with said evaporator coils thereby reactive to any temperature changes thereof;

h) a plurality of transverse vents extending through said evaporator unit and said condenser unit to allow for the transfer of treated air therethrough;

i) an evaporator fan to recycle air flow from the interior to present air flow through said evaporator unit to dissipate conditioned air into the room being treated;

j) a condenser fan to present air flow through said condenser unit to dissipate heat to the outside air;

k) an electrical control circuit for regulating the operation of the present invention; and l) a control panel to enable the to user to dictate the function and desired real temperature output of the present invention, wherein said evaporator unit further includes a heat element disposed within said fluid within said reservoir to heat said fluid when called upon.

2. A real temperature output air conditioner as recited in claim 1, wherein said gas is a refrigerant.

3. A real temperature output air conditioner as recited in claim 2, wherein said refrigerant is a non-flammable fluorocarbon.

4. A real temperature output air conditioner as recited in claim 1, wherein said electrical control circuit comprises:

a) a power switch to supply AC current to said electrical control circuit;

b) an air thermostat in communication with the ambient air to respond during start-up when the air temperature needs to be adjusted;

c) a fluid thermostat in communication with said fluid to maintain a stable fluid temperature once the desired real temperature output has been reached by turning said compressor and said condenser fan on when the fluid temperature begins to deviate from the desired real temperature output and turning them off when fluid temperature and desired real temperature output are equal;

d) a control unit for directing current from said air thermostat to said fluid thermostat after the start-up phase in response to the air thermostat detecting that the ambient air has reached the desired temperature;

e) a heat thermostat in communication with said fluid and said heat element to maintain a stable fluid temperature; and f) a function switch for directing current between said heating element and said control unit to activate the heat cycle or the cooling cycle as needed.

5. A real temperature output air conditioner as recited in claim 1, wherein said control panel comprises:

a) means for supplying power to said electrical control circuit; and b) at least one means for setting desired real temperature output.

6. A real temperature output air conditioner as recited in claim 5, wherein said control panel further includes means for selecting between cooling cycle and heater mode.

7. A real temperature output air conditioner as recited in claim 5, wherein said control panel is digital.

8. A real temperature output air conditioner as recited in claim 5, wherein said control panel is manual.

9. A real temperature output air conditioner as recited in claim 1, wherein said evaporator unit further includes a pressure relief valve disposed on the top portion thereof.

10. A real temperature output air conditioner as recited in claim 1, wherein said evaporator unit further includes a drain means disposed on a bottom portion thereof.

11. A real temperature output air conditioner as recited in claim 10, wherein said drain means is a petcock.

12. A real temperature output air conditioner as recited in claim 1, wherein said evaporator fan further includes a variable speed control to provide user adjustability of the fan speed.

13. A real temperature output air conditioner as recited in claim 4, wherein said air thermostat is only operating said compressor and said condenser fan during the start-up cycle which occurs when operation of the present invention is initiated and does not operate again after transferring thermal control to said fluid thermostat until said air conditioner is turned off and turned on again thereby initiating the star-up cycle.

14. A real temperature output air conditioner as recited in claim 1, wherein said evaporator unit further includes a fill port to provide access to said reservoir for adding fluid thereto.

15. A real temperature output air conditioner as recited in claim 1, wherein said fluid thermostat and said air thermostat always are set to the same temperature as determined by a single control switch.

16. A real temperature output air conditioner as recited in claim 1, wherein said fluid is non-corrosive.

17. A real temperature output air conditioner as recited in claim 1, wherein said fluid is oil.

18. A real temperature output air conditioner as recited in claim 8, wherein a single control switch governs the operation of said air thermostat.

19. A real temperature output air conditioner as recited in claim 8, further including a user control switch for said heater thermostat.

20. A real temperature output air conditioner as recited in claim 7, wherein said air thermostat, said fluid thermostat and said heater thermostat are controlled by a digital thermostat control and will initiate the cooling cycle or heating cycle accordingly to maintain the selected temperature output as needed.

* * * * *